US006973878B2

(12) United States Patent
Lloyd et al.

(10) Patent No.: US 6,973,878 B2
(45) Date of Patent: Dec. 13, 2005

(54) WARHEAD WITH ALIGNED PROJECTILES

(75) Inventors: Richard M. Lloyd, Melrose, MA (US); Ernest C. Faccini, Londonderry, NH (US)

(73) Assignee: Raytheon Company, Waltham, MA (US)

( * ) Notice: Subject to any disclaimer, the term of this patent is extended or adjusted under 35 U.S.C. 154(b) by 151 days.

(21) Appl. No.: 10/456,391

(22) Filed: Jun. 5, 2003

(65) Prior Publication Data

US 2004/0055500 A1 Mar. 25, 2004

Related U.S. Application Data

(62) Division of application No. 09/938,022, filed on Aug. 23, 2001, now Pat. No. 6,598,534.
(60) Provisional application No. 60/295,731, filed on Jun. 4, 2001.

(51) Int. Cl.[7] ..... F42B 12/22
(52) U.S. Cl. ..... 102/494; 102/475
(58) Field of Search ..... 152/494, 475

(56) References Cited

U.S. PATENT DOCUMENTS

| | | | | |
|---|---|---|---|---|
| 1,198,035 A | | 9/1916 | Huntington | |
| 1,229,421 A | | 6/1917 | Downs | |
| 1,235,076 A | | 7/1917 | Stanton | |
| 1,244,046 A | * | 10/1917 | French | 102/494 |
| 1,300,333 A | * | 4/1919 | Berry | 102/383 |
| 1,305,967 A | | 6/1919 | Hawks | |
| 2,296,980 A | | 9/1942 | Carmichael | |
| 2,308,683 A | | 1/1943 | Forbes | |
| 2,322,624 A | | 6/1943 | Forbes | |
| 2,337,765 A | | 12/1943 | Nahirney | |
| 2,925,965 A | | 2/1960 | Pierce | |
| 2,988,994 A | | 6/1961 | Fleischer, Jr. et al. | |
| 3,332,348 A | | 7/1967 | Myers et al. | |

(Continued)

FOREIGN PATENT DOCUMENTS

| | | |
|---|---|---|
| DE | 3327043 A1 | 2/1985 |
| DE | 38 30 527 A1 | 3/1990 |
| DE | 3934042 A1 | 4/1991 |
| EP | 270 401 A1 | 6/1988 |
| FR | 2 678 723 | 1/1993 |
| GB | 550001 | 12/1942 |
| GB | 2236581 | 4/1991 |
| JP | 1-296100 | 11/1989 |
| WO | WO 97/27447 | 7/1997 |

OTHER PUBLICATIONS

U.S. patent application Ser. No. 10/162,498, Lloyd, filed Jun. 4, 2002.

(Continued)

*Primary Examiner*—Michael J. Carole
*Assistant Examiner*—Troy Chambers
(74) *Attorney, Agent, or Firm*—Iandiorio & Teska

(57) ABSTRACT

A kinetic energy rod warhead with aligned projectiles includes a projectile core in a hull including a plurality of individual projectiles and an explosive charge in the hull about the core. The individual projectiles are aligned when the explosive charge deploys the projectiles. The projectiles may also be aimed in a specific direction.

19 Claims, 15 Drawing Sheets

U.S. PATENT DOCUMENTS 3,565,009 A * 2/1971 Alfred et al. ..... 102/475
3,656,433 A 4/1972 Thrailkill et al.
3,665,009 A 5/1972 Dickinson, Jr.
3,757,694 A * 9/1973 Talley et al. ..... 102/495
3,771,455 A 11/1973 Haas
3,796,159 A 3/1974 Conger
3,797,359 A 3/1974 Mawhinney et al.
3,818,833 A 6/1974 Throner, Jr.
3,846,878 A 11/1974 Monson et al.
3,851,590 A 12/1974 LaCosta
3,861,314 A 1/1975 Barr
3,877,376 A * 4/1975 Kupelian ..... 102/492
3,902,424 A 9/1975 Dietsch et al.
3,903,804 A 9/1975 Luttrell et al.
3,915,092 A 10/1975 Monson et al.
3,941,059 A 3/1976 Cobb
3,949,674 A * 4/1976 Talley ..... 102/476
3,954,060 A 5/1976 Haag et al.
3,977,330 A 8/1976 Held
4,026,213 A * 5/1977 Kempton ..... 102/475
4,036,140 A * 7/1977 Korr et al. ..... 102/438
4,089,267 A * 5/1978 Mescall et al. ..... 102/491
4,106,410 A 8/1978 Borcher et al.
4,147,108 A 4/1979 Gore et al.
4,172,407 A 10/1979 Wentink
4,210,082 A 7/1980 Brothers
4,211,169 A * 7/1980 Brothers ..... 102/494
4,231,293 A 11/1980 Dahn et al.
4,289,073 A 9/1981 Romer et al.
4,376,901 A 3/1983 Pettibone et al.
4,430,941 A 2/1984 Raech, Jr. et al.
4,455,943 A 6/1984 Pinson
4,516,501 A 5/1985 Held et al.
4,538,519 A 9/1985 Witt et al.
4,638,737 A 1/1987 McIngvale
4,655,139 A * 4/1987 Wilhelm ..... 102/494
4,658,727 A * 4/1987 Wilhelm et al. ..... 102/494
4,676,167 A 6/1987 Huber, Jr. et al.
4,745,864 A * 5/1988 Craddock ..... 102/491
4,770,101 A 9/1988 Robertson et al.
4,777,882 A 10/1988 Dieval
4,848,239 A 7/1989 Wilhelm
4,922,826 A 5/1990 Busch et al.
4,957,046 A 9/1990 Puttock
4,995,573 A 2/1991 Wallow
4,996,923 A 3/1991 Theising
H001047 H * 5/1992 Henderson et al. ..... 102/496
H001048 H * 5/1992 Wilson et al. ..... 102/496
5,182,418 A 1/1993 Talley
5,223,667 A 6/1993 Anderson
5,229,542 A * 7/1993 Bryan et al. ..... 102/491
5,313,890 A 5/1994 Cuadros
5,370,053 A * 12/1994 Williams et al. ..... 102/202.5
5,524,524 A 6/1996 Richards et al.
5,535,679 A 7/1996 Craddock
5,542,354 A 8/1996 Sigler
5,544,589 A * 8/1996 Held ..... 102/492
5,577,431 A 11/1996 Kusters
5,578,783 A 11/1996 Brandeis
5,583,311 A 12/1996 Rieger
5,622,335 A 4/1997 Trouillot et al.
D380,784 S 7/1997 Smith
5,670,735 A * 9/1997 Ortmann et al. ..... 102/202
5,691,502 A * 11/1997 Craddock et al. ..... 102/494
5,796,031 A 8/1998 Sigler
5,823,469 A 10/1998 Arkhangelsky et al.
5,851,185 A 12/1998 Berns
5,929,370 A 7/1999 Brown et al.
5,936,191 A 8/1999 Bisping et al.
6,035,501 A 3/2000 Bisping et al.
6,044,765 A 4/2000 Regebro
6,186,070 B1 2/2001 Fong et al.
6,276,277 B1 8/2001 Schmacker
6,279,478 B1 8/2001 Ringer et al. ..... 102/213
6,279,482 B1 8/2001 Smith et al. ..... 102/374
6,598,534 B2 7/2003 Lloyd et al.
6,622,632 B1 * 9/2003 Spivak ..... 102/475
6,666,145 B1 12/2003 Nardone et al.
2003/0019386 A1 1/2003 Lloyd et al.
2004/0011238 A1 1/2004 Ronn et al.

OTHER PUBLICATIONS

U.S. patent application Ser. No. 10/301,302, Lloyd, filed Nov. 21, 2002.
Richard M. Lloyd "Physics of Direct Hit and Near Miss Warhead Technology", vol. 194 Progress in Astronautics and Aeronautics, Copyright 2001 by the American Institute of Aeronautics and Astronautics, Inc., Chapter 3, pp. 99–197.
Richard M. Lloyd "Physics of Direct Hit and Near Miss Warhead Technology", vol. 194 Progress in Astronautics and Aeronautics, Copyright 2001 by the American Institute of Aeronautics and Astronautics, Inc., Chapter 6, pp. 311–406.
U.S. patent application Ser. No. 10/301,420, Lloyd, filed Nov. 21, 2002.
U.S. patent application Ser. No. 10/384,804. Lloyd, filed Mar. 10, 2003.
U.S. patent application Ser. No. 10/385,319, Lloyd, filed Mar. 10, 2003.
U.S. patent application Ser. No. 10/456,777, Lloyd, filed Jun. 6, 2003.
U.S. patent application Ser. No. 10/698,500, Lloyd, filed Oct. 31,2003.
U.S. patent application Ser. No. 10/370,892, Lloyd, filed Feb. 20, 2003.
U.S. patent application Ser. No. 10/685,242, Lloyd, filed Oct. 14, 2003.
Richard M. Lloyd, "Convential Warhead Systems Physics and Enginneering Design", vol. 179, Progess in Astronautics and Aeronautics, Copyright 1998 by the American Institute of Aeronautics and Astronautics, Inc., Chapter 5, pp. 193–251.
Richard M. Lloyd, "Aligned Rod Lethality Enhanced Concept for Kill Vehicles", 10th AIAA/BMDD Technology Conf., Jul. 23–26, Williamsburg, Virginia, 2001, pp. 1–12.
FAS Military Analysis Network (http://www.fas.org/man/dod–101/sys/land/m546.htm): M546 APERS–T 105–mm, Jan. 21, 1999.
PAS Military Analysis Network (http://www.fas.org/man/dod–101/sys/land/bullets2.htm): Big Bullets for Beginners, Feb. 6, 2000.
U.S. Appl. No. 10/924,104, Lloyd, filed Aug. 23, 2004.
U.S. Appl. No. 10/938,355, Lloyd, filed Sep. 10, 2004.
U.S. Appl. No. 10/960,842, Lloyd, filed Oct. 7, 2004.

* cited by examiner

WARHEAD WITH ALIGNED PROJECTILES

RELATED APPLICATIONS

This application is a divisional application of U.S. patent application Ser. No. 09/938,022 filed Aug. 23, 2001 now U.S. Pat. No. 6,598,534, which claims priority from Provisional Application Ser. No. 60/295,731 filed Jun. 4, 2001. U.S. patent application Ser. No. 09/938,022 filed Aug. 23, 2001 is hereby incorporated herein by reference.

FIELD OF THE INVENTION

This invention relates to improvements in kinetic energy rod warheads.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads.

"Hit-to-kill" vehicles are typically launched into a position proximate a re-entry vehicle or other target via a missile such as the Patriot, Trident or MX missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the target and, again, biological bomblets and/or chemical submunition payloads survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook, proposes a kinetic energy rod warhead.

The two primary advantages of a kinetic energy rod warheads is that 1) it does not rely on precise navigation as is the case with "hit-to-kill" vehicles and 2) it provides better penetration then blast fragmentation type warheads.

To date, however, kinetic energy rod warheads have not been widely accepted nor have they yet been deployed or fully designed. The primary components associated with a theoretical kinetic energy rod warhead is a hull, a projectile core or bay in the hull including a number of individual lengthy cylindrical projectiles, and an explosive charge in the hull about the projectile bay with sympthic explosive shields. When the explosive charge is detonated, the projectiles are deployed.

The cylindrical shaped projectiles, however, may tend to break and/or tumble in their deployment. Still other projectiles may approach the target at such a high oblique angle that they do not effectively penetrate the target. See "Aligned Rod Lethality Enhanced Concept for Kill Vehicles," R. Lloyd "Aligned Rod Lethality Enhancement Concept For Kill Vehicles" $10^{th}$ AIAA/BMDD TECHNOLOGY CONF., Jul. 23–26, Williamsburg, Va., 2001 incorporated herein by this reference.

SUMMARY OF THE INVENTION

It is therefore an object of this invention to provide an improved kinetic energy rod warhead.

It is a further object of this invention to provide a higher lethality kinetic energy rod warhead.

It is a further object of this invention to provide a kinetic energy rod warhead with structure therein which aligns the projectiles when they are deployed.

It is a further object of this invention to provide such a kinetic energy rod warhead which is capable of selectively directing the projectiles at a target.

It is a further object of this invention to provide such a kinetic energy rod warhead which prevents the projectiles from breaking when they are deployed.

It is a further object of this invention to provide such a kinetic energy rod warhead which prevents the projectiles from tumbling when they are deployed.

It is a further object of this invention to provide such a kinetic energy rod warhead which insures the projectiles approach the target at a better penetration angle.

It is a further object of this invention to provide such a kinetic energy rod warhead which can be deployed as part of a missile or as part of a "hit-to-kill" vehicle.

It is a further object of this invention to provide such a kinetic energy rod warhead with projectile shapes which have a better chance of penetrating a target.

It is a further object of this invention to provide such a kinetic energy rod warhead with projectile shapes which can be packed more densely.

It is a further object of this invention to provide such a kinetic energy rod warhead which has a better chance of destroying all of the bomblets and chemical submunition payloads of a target to thereby better prevent casualties.

The invention results from the realization that a higher lethality kinetic energy rod warhead can be effected by the inclusion of means for angling the individual projectiles when they are deployed to prevent the projectiles from tumbling and to provide a better penetration angle; by selectively directing the projectiles at the target, and also by incorporating special shaped projectiles.

This invention features a kinetic energy rod warhead with aligned projectiles. The warhead comprises a hull, a projectile core in the hull including a plurality of individual projectiles, an explosive charge in the hull about the core, and means for aligning the individual projectiles when the explosive charge deploys the projectiles.

In one example, the means for aligning the projectiles includes a plurality of detonators spaced along the explosive charge configured to prevent sweeping shock waves at the interface of the projectile core and the explosive charge to prevent tumbling of the projectiles. In another example the means for aligning includes a foam body in the core with orifices therein, the projectiles disposed in the orifices of the body. In still another example, the means for aligning includes at least one flux compression generator which generates an alignment field to align the projectiles. Typically, there are two flux compression generators, one on each end of the projectile core. Each such flux compression generator includes a magnetic core element, a number of coils about the magnetic core element, and an explosive for imploding the magnetic core element.

The hull is usually either the skin of a missile or a portion of a "hit-to-kill" vehicle. In most embodiments the explosive charge is disposed outside the core. But, in one example, the explosive charge is disposed inside the core. A buffer material such as foam may be disposed between the core and the explosive charge.

The projectiles are typically lengthy metallic members made of tungsten, for example. In one example the projectiles have a cylindrical cross section and flat ends. In the preferred embodiment, however, the projectiles have a non-cylindrical cross section: a star-shaped cross section or a cruciform cross section. Preferably, the projectiles have pointed noses or wedge-shaped noses.

Shields may also be located between each explosive charge section extending between the hull and the projectile core. The shields are typically made of a composite material, in one example, steel sandwiched between lexan layers. In one example, the projectile core is divided into a plurality of bays. Also, the explosive charge is divided into a plurality of sections and there is at least one detonator per section for selectively detonating the charge sections to aim the projectiles in a specific direction and to control the spread pattern of the projectiles. Each explosive charge section is preferably wedged-shaped having a proximal surface abutting the projectile core and a distal surface. The distal surface is typically tapered to reduce weight. In most embodiments, the detonators are chip slappers.

One kinetic energy rod warhead with aligned projectiles in accordance with this includes a hull, a projectile core in the hull including a plurality of individual projectiles, an explosive charge in the hull about the core, and a plurality of detonators spaced along the explosive charge configured to prevent sweeping shock waves at the interface of the projectile core and the explosive charge to prevent tumbling of the projectiles.

Another kinetic energy rod warhead with aligned projectiles in accordance with this invention features a hull, a projectile core in the hull including a plurality of individual projectiles, an explosive charge in the hull about the core, and a body in the core with orifices therein, the projectiles disposed in the orifices of the body.

Still another kinetic energy rod warhead with aligned projectiles in accordance with this invention includes a hull, a projectile core in the hull including a plurality of individual projectiles, an explosive charge in the hull about the core, and at least one flux compression generator which generates an alignment field to align the projectiles.

In one example, the kinetic energy rod warhead with aligned projectiles of this invention has a hull, a projectile core in the hull including a plurality of individual projectiles, an explosive charge in the hull about the core, a plurality of detonators spaced along the explosive charge configured to prevent sweeping shock waves at the interface of the projectile core and the explosive charge, a body in the core with orifices therein, the projectiles disposed in the orifices of the body, and at least one compression flux generator for magnetically aligning the projectiles.

The exemplary kinetic energy rod warhead of this invention includes a hull, a projectile core in the hull including a plurality of individual projectiles, an explosive charge in the hull about the core, means for aligning the individual projectiles when the explosive charge deploys the projectiles, and means for aiming the aligned projectiles in a specific direction.

The means for aligning may include a plurality of detonators spaced along the explosive charge configured to prevent sweeping shock waves at the interface of the projectile core and the explosive charge to prevent tumbling of the projectiles, a body in the core with orifices therein, the projectiles disposed in the orifices of the body, and/or one or more flux compression generators which generate an alignment field to align the projectiles.

The means for aiming, in one example, includes a plurality of explosive charge sections and at least one detonator per section for selectively detonating the charge sections to aim the projectiles in a specific direction and to control the spread pattern of the projectiles.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENTS

Figure 1:
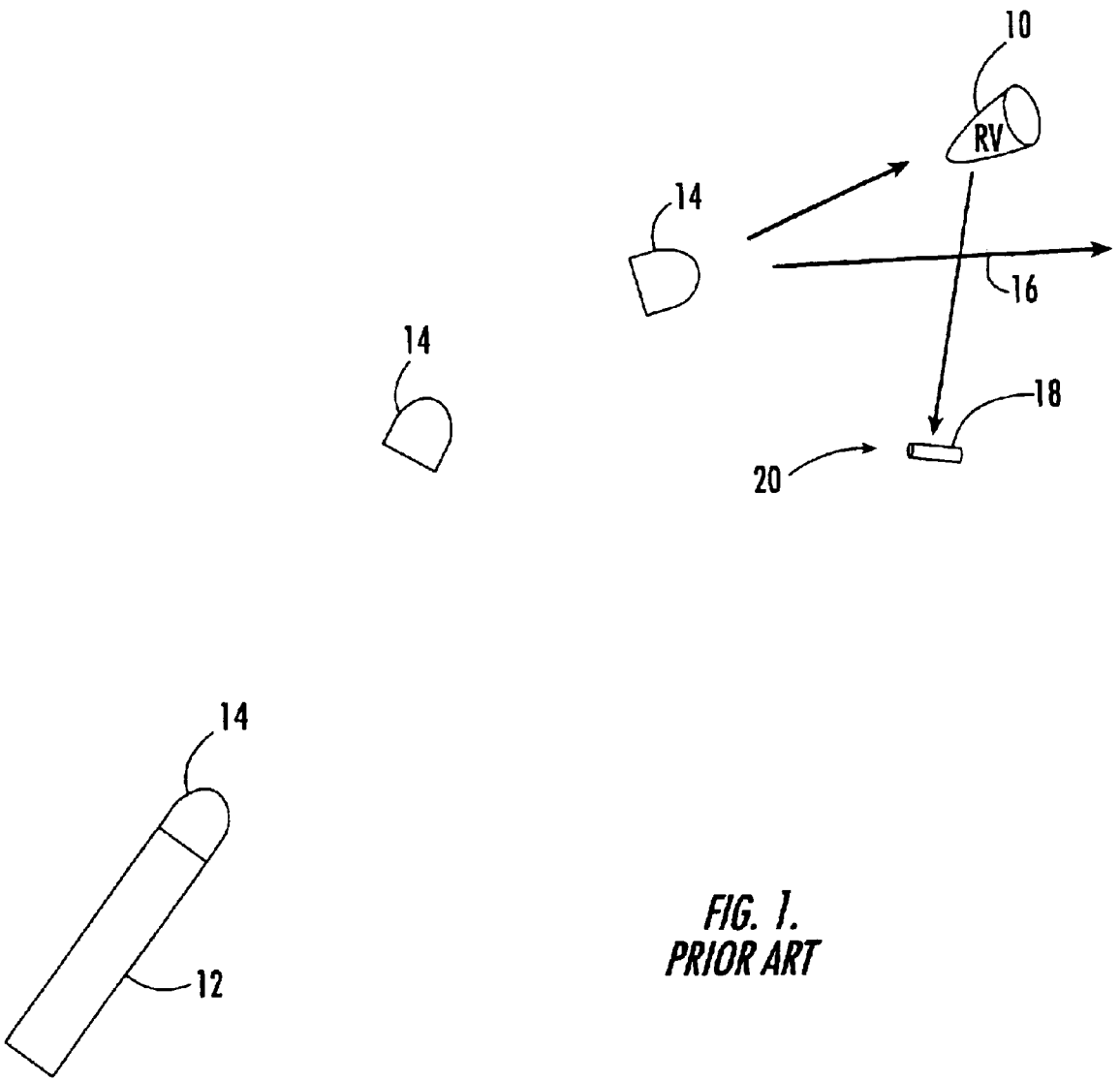
FIG. 1. PRIOR ART
FIG. 1 is schematic view showing the typical deployment of a "hit-to-kill" vehicle in accordance with the prior art.

As discussed in the Background section above, "hit-to-kill" vehicles are typically launched into a position proximate a re-entry vehicle 10, FIG. 1 or other target via a missile 12. "Hit-to-kill" vehicle 14 is navigable and designed to strike re-entry vehicle 10 to render it inoperable. Countermeasures, however, can be used to avoid the kill vehicle. Vector 16 shows kill vehicle 14 missing re-entry vehicle 10. Moreover, biological bomblets and chemical submunition payloads 18 are carried by some threats and one or more of these bomblets or chemical submunition payloads 18 can survive, as shown at 20, and cause heavy casualties even if kill vehicle 14 does accurately strike target 10.

Figure 2:
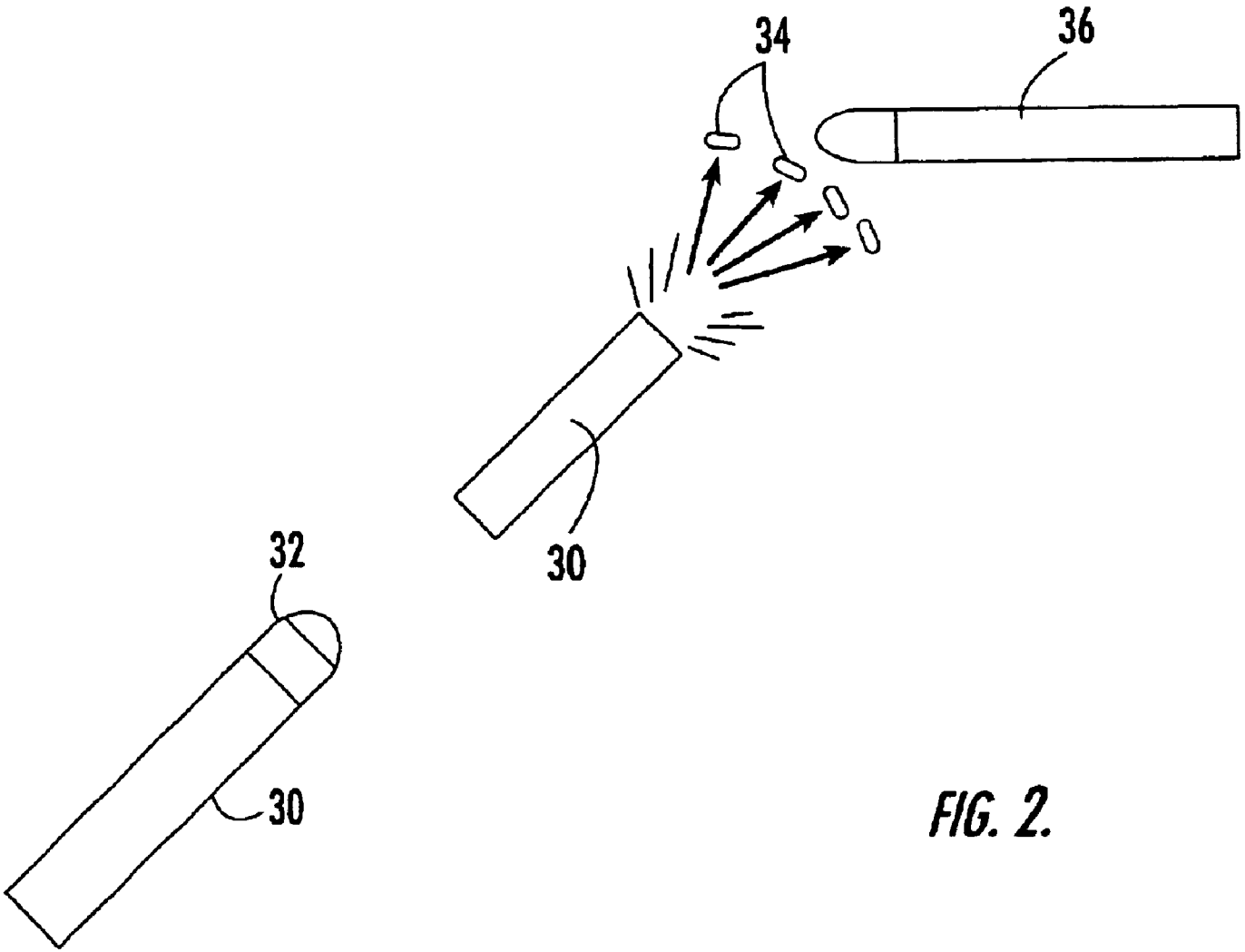
FIG. 2 is schematic view showing the typical deployment of a prior art blast fragmentation type warhead.

Turning to FIG. 2, blast fragmentation type warhead 32 is designed to be carried by missile 30. When the missile reaches a position close to an enemy re-entry vehicle (RV), missile, or other target 36, a pre-made band of metal or fragments on the warhead is detonated and the pieces of metal 34 strike target 36. The fragments, however, are not always effective at destroying the submunition target and, again, biological bomblets and/or chemical submunition payloads can survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook, proposes a kinetic energy rod warhead.

Figure 3:
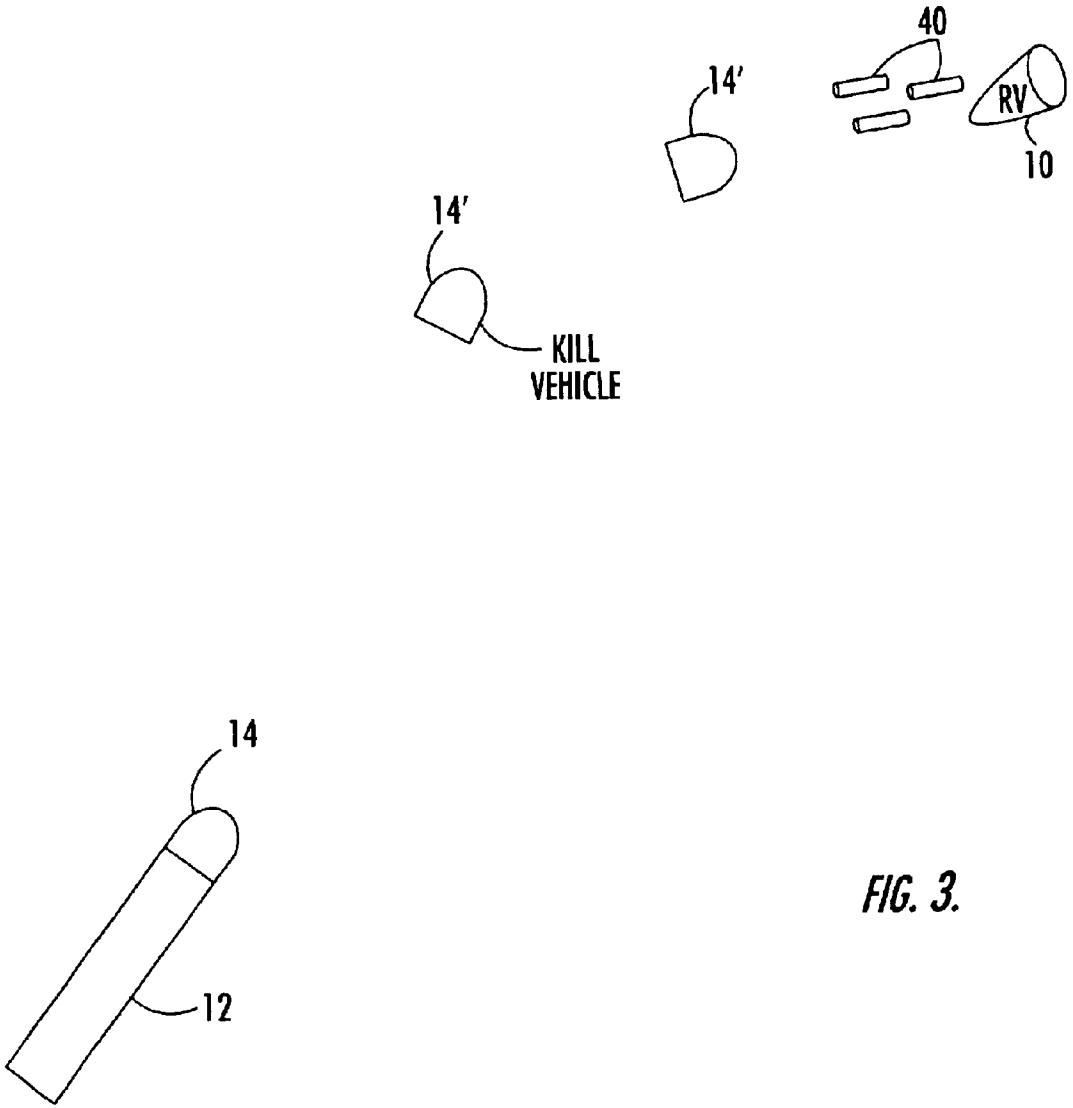
FIG. 3 is schematic view showing the deployment of a kinetic energy rod warhead system incorporated with a "hit-to-kill" vehicle in accordance with the subject invention.
Figure 4:
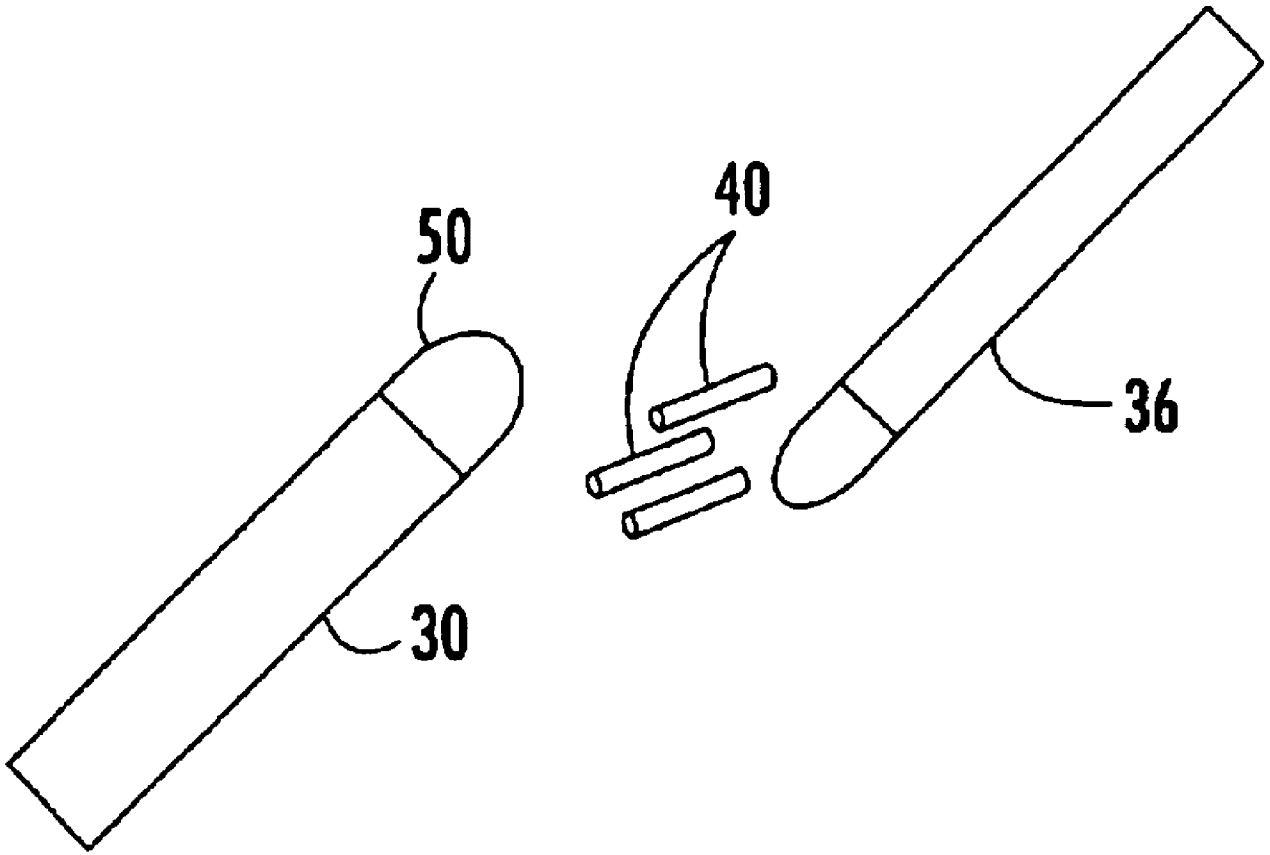
FIG. 4 is schematic view showing the deployment of a kinetic energy rod warhead as a replacement for a blast fragmentation type warhead in accordance with the subject invention.

In general, a kinetic energy rod warhead, in accordance with this invention, can be added to kill vehicle 14, FIG. 3 to deploy lengthy cylindrical projectiles 40 directed at re-entry vehicle 10 or another target. In addition, the prior art blast fragmentation type warhead shown in FIG. 2 can be replaced with or supplemented with a kinetic energy rod warhead 50, FIG. 4 to deploy projectiles 40 at target 36.

Two key advantages of kinetic energy rod warheads as theorized is that 1) they do not rely on precise navigation as is the case with "hit-to-kill" vehicles and 2) they provide better penetration then blast fragmentation type warheads.

Figure 5:
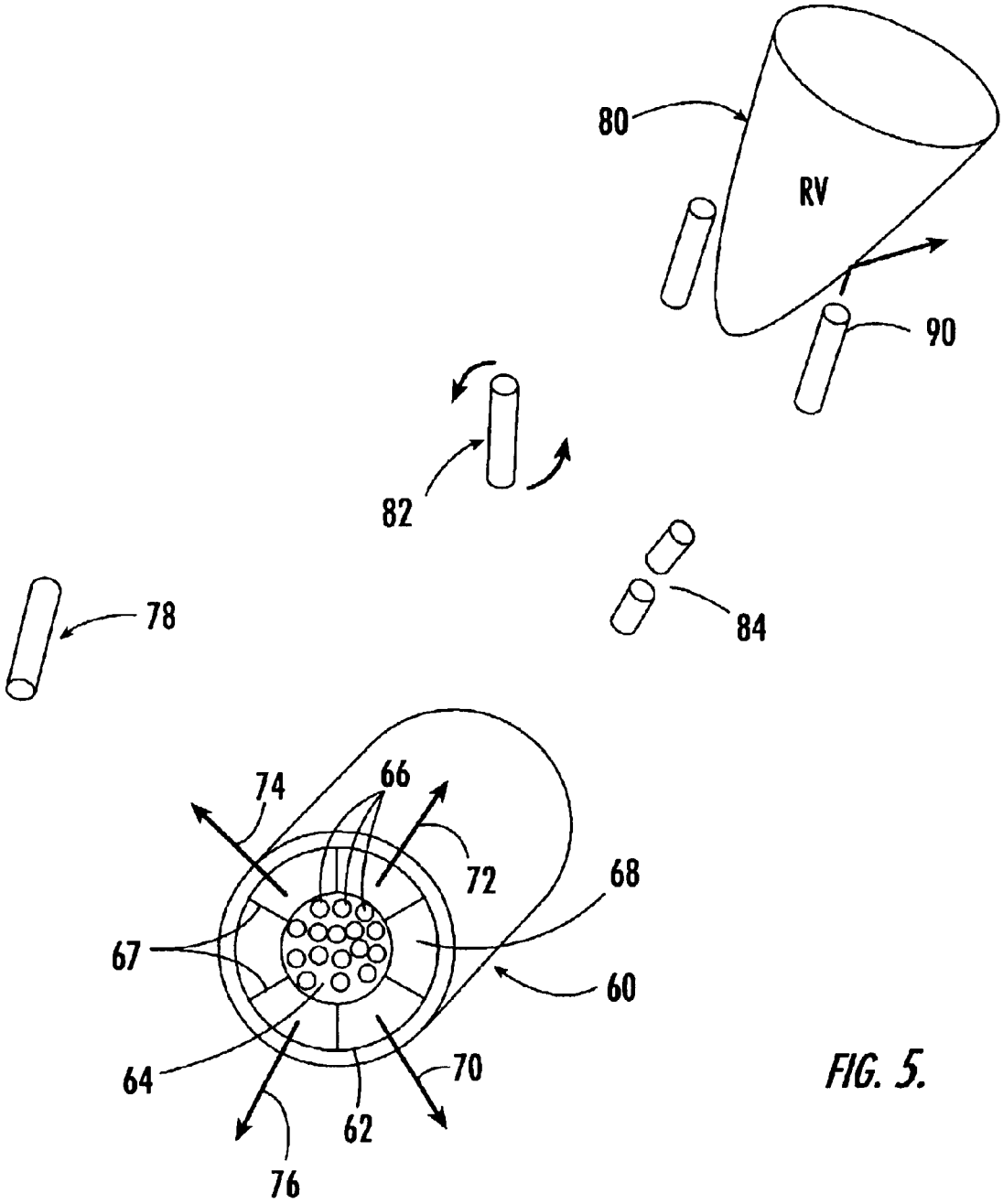
FIG. 5 is a more detailed view showing the deployment of the projectiles of a kinetic energy rod warhead at a target in accordance with the subject invention.

To date, however, kinetic energy rod warheads have not been widely accepted nor have they yet been deployed or fully designed. The primary components associated with a theoretical kinetic energy rod warhead 60, FIG. 5 is hull 62, projectile core or bay 64 in hull 62 including a number of individual lengthy cylindrical rod projectiles 66, sympethic shield 67, and explosive charge 68 in hull 62 about bay or core 64. When explosive charge 66 is detonated, projectiles 66 are deployed as shown by vectors 70, 72, 74, and 76.

Note, however, that in FIG. 5 the projectile shown at 78 is not specifically aimed or directed at re-entry vehicle 80. Note also that the cylindrical shaped projectiles may tend to break upon deployment as shown at 84. The projectiles may also tend to tumble in their deployment as shown at 82. Still other projectiles approach target 80 at such a high oblique angle that they do not penetrate target 80 effectively as shown at 90.

In this invention, the kinetic energy rod warhead includes, inter alia, means for aligning the individual projectiles when the explosive charge is detonated and deploys the projectiles to prevent them from tumbling and to insure the projectiles approach the target at a better penetration angle.

Figure 6:
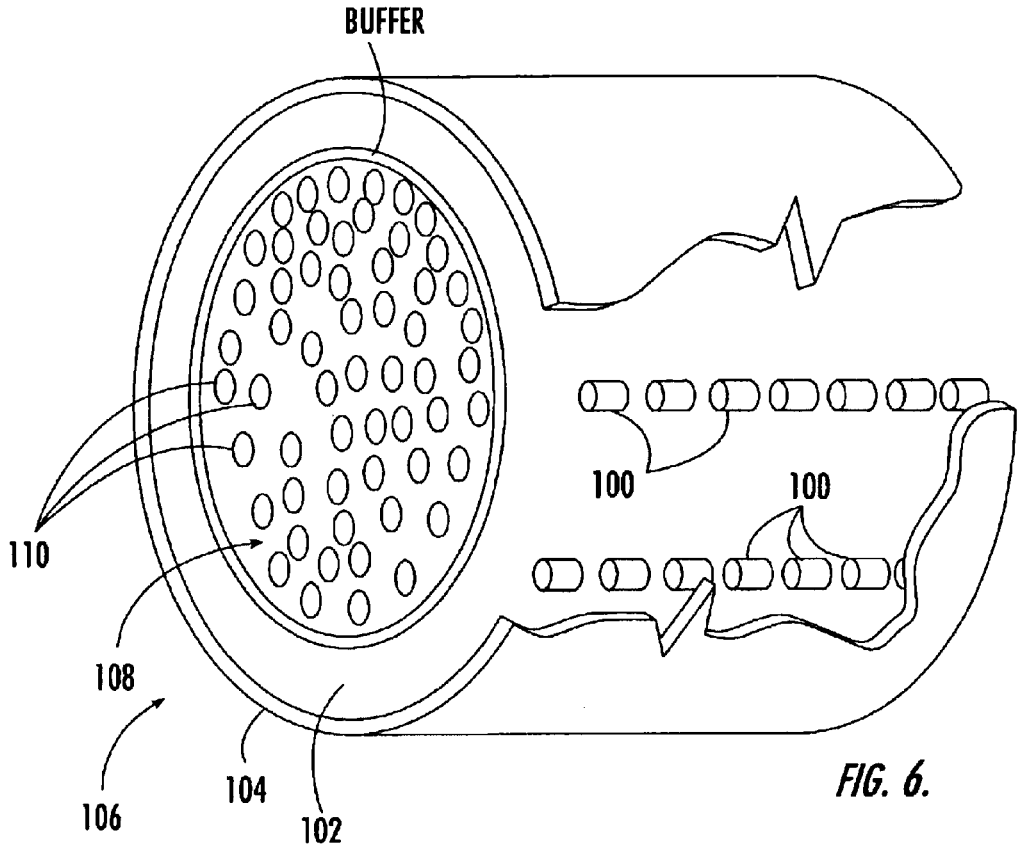
FIG. 6 is three-dimensional partial cut-away view of one embodiment of the kinetic energy rod warhead system of the subject invention.

In one example, the means for aligning the individual projectiles include a plurality of detonators 100, FIG. 6 (typically chip slapper type detonators) spaced along the length of explosive charge 102 in hull 104 of kinetic energy rod warhead 106. As shown in FIG. 6, projectile core 108 includes many individual lengthy cylindrical projectiles 110 and, in this example, explosive charge 102 surrounds projectile core 108. By including detonators 100 spaced along the length of explosive charge 102, sweeping shock waves are prevented at the interface between projectile core 108 and explosive charge 102 which would otherwise cause the individual projectiles 110 to tumble.

Figure 7:
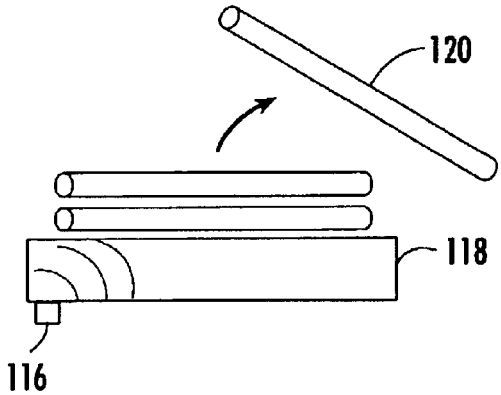
FIG. 7 is schematic cross-sectional view showing a tumbling projectile in accordance with prior kinetic energy rod warhead designs.

As shown in FIG. 7, if only one detonator 116 is used to detonate explosive 118, a sweeping shockwave is created which causes projectile 120 to tumble. When this happens, projectile 120 can fracture, break or fail to penetrate a target which lowers the lethality of the kinetic energy rod warhead.

By using a plurality of detonators 100 spaced along the length of explosive charge 108, a sweeping shock wave is prevented and the individual projectiles 100 do not tumble as shown at 122.

Figure 9:
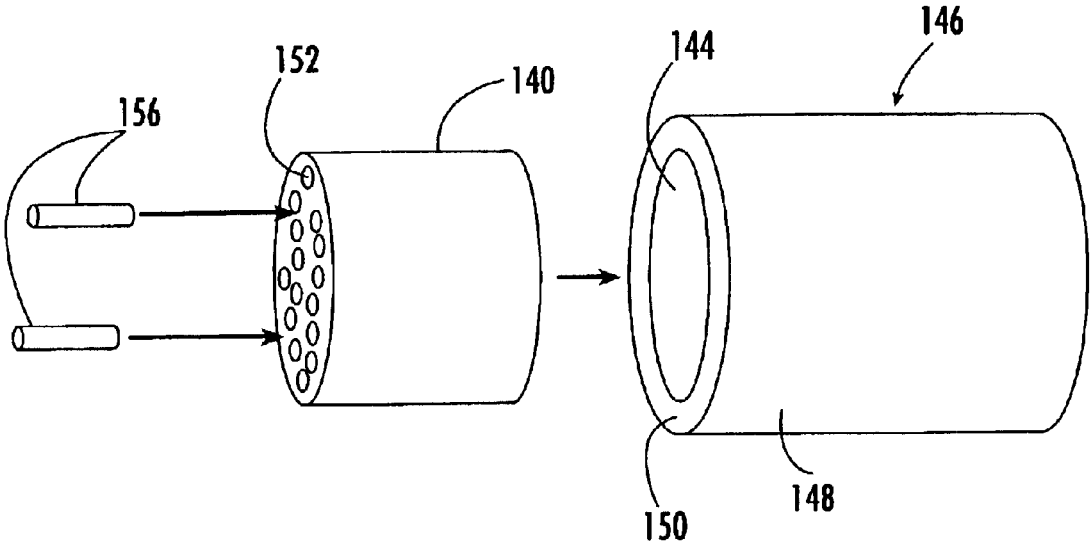
FIG. 9 is an exploded schematic three-dimensional view showing the use of a kinetic energy rod warhead core body used to align the projectiles in accordance with the subject invention.

In another example, the means for aligning the individual projectiles includes low density material (e.g., foam) body 140, FIG. 9 disposed in core 144 of kinetic energy rod warhead 146 which, again, includes hull 148 and explosive charge 150. Body 140 includes orifices 152 therein which receive projectiles 156 as shown. The foam matrix acts as a rigid support to hold all the rods together after initial deployment. The explosive accelerates the foam and rods toward the RV or other target. The foam body holds the rods stable for a short period of time keeping the rods aligned. The rods stay aligned because the foam reduces the explosive gases venting through the packaged rods.

Figure 8:
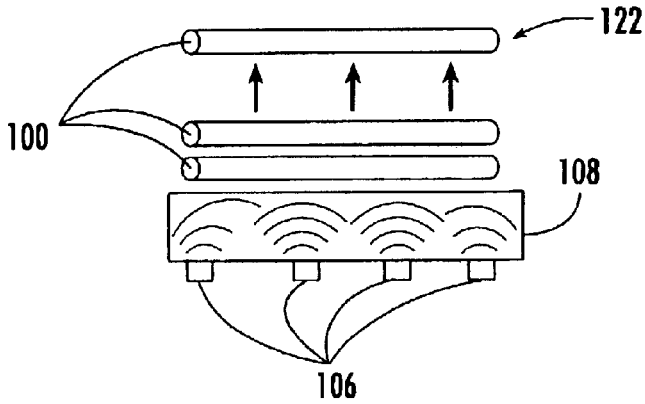
FIG. 8 is another schematic cross-sectional view showing how the use of multiple detonators aligns the projectiles to prevent tumbling thereof in accordance with the subject invention.

In one embodiment, foam body 140, FIG. 9 maybe combined with the multiple detonator design of FIGS. 6 and 8 for improved projectile alignment.

Figure 10:
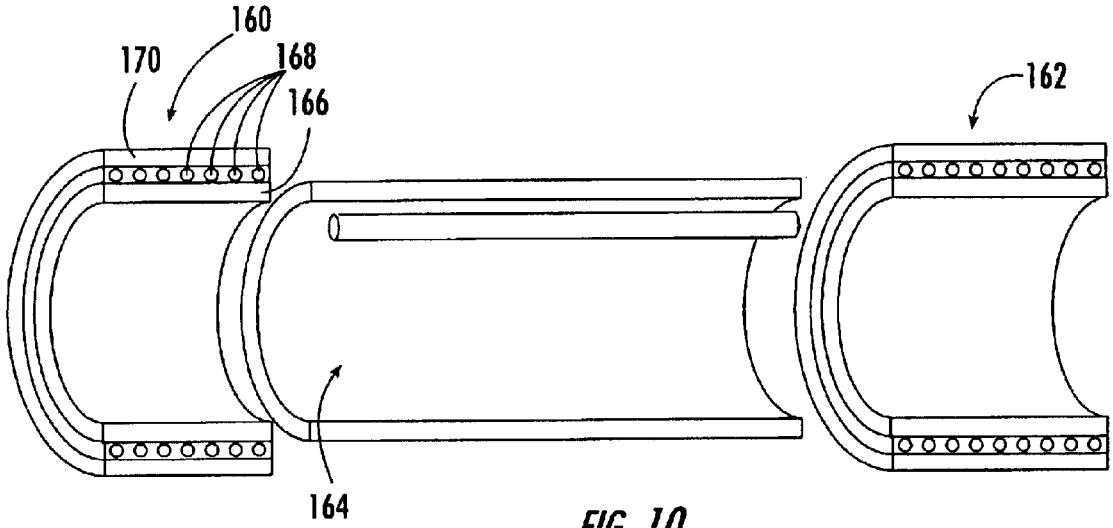
FIGS. 10 and 11 are schematic cut-away views showing the use of flux compression generators used to align the projectiles of the kinetic energy rod warhead in accordance with the subject invention.

In still another example, the means for aligning the individual projectiles to prevent tumbling thereof includes flux compression generators 160 and 162, FIG. 10, one on each end of projectile core 164 each of which generate a magnetic alignment field to align the projectiles. Each flux compression generator includes magnetic core element 166 as shown for flux compression generator 160, a number of coils 168 about core element 166, and explosive charge 170 which implodes magnetic core element when explosive charge 170 is detonated. The specific design of flux compression generators is known to those skilled in the art and therefore no further details need be provided here.

Figure 11:
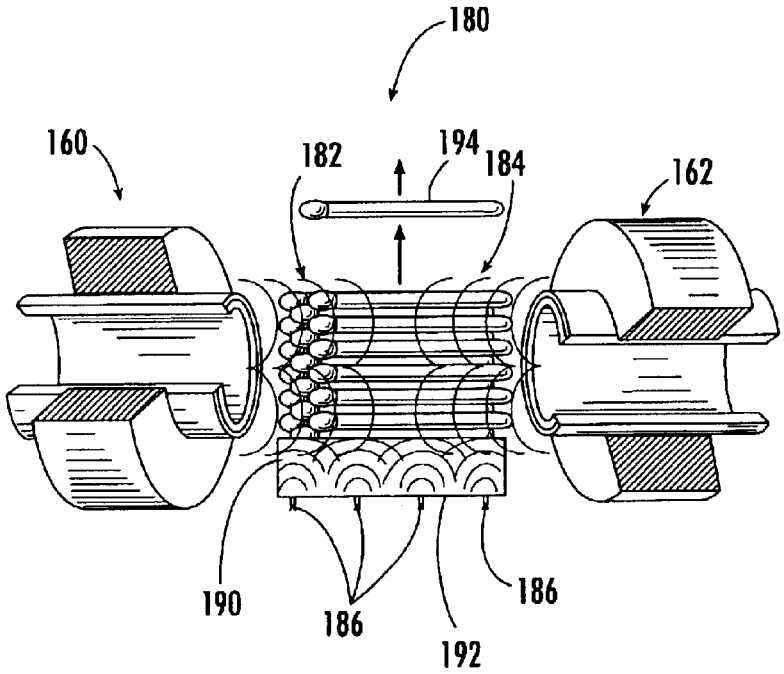

As shown in FIG. 11, kinetic energy rod warhead 180 includes flux compression generators 160 and 162 which generate the alignment fields shown at 182 and 184 and also multiple detonators 186 along the length of explosive charge 190 which generate a flat shock wave front as shown at 192 to align the projectiles at 194. As stated above, foam body 140 may also be included in this embodiment to assist with projectile alignment.

Figure 12:
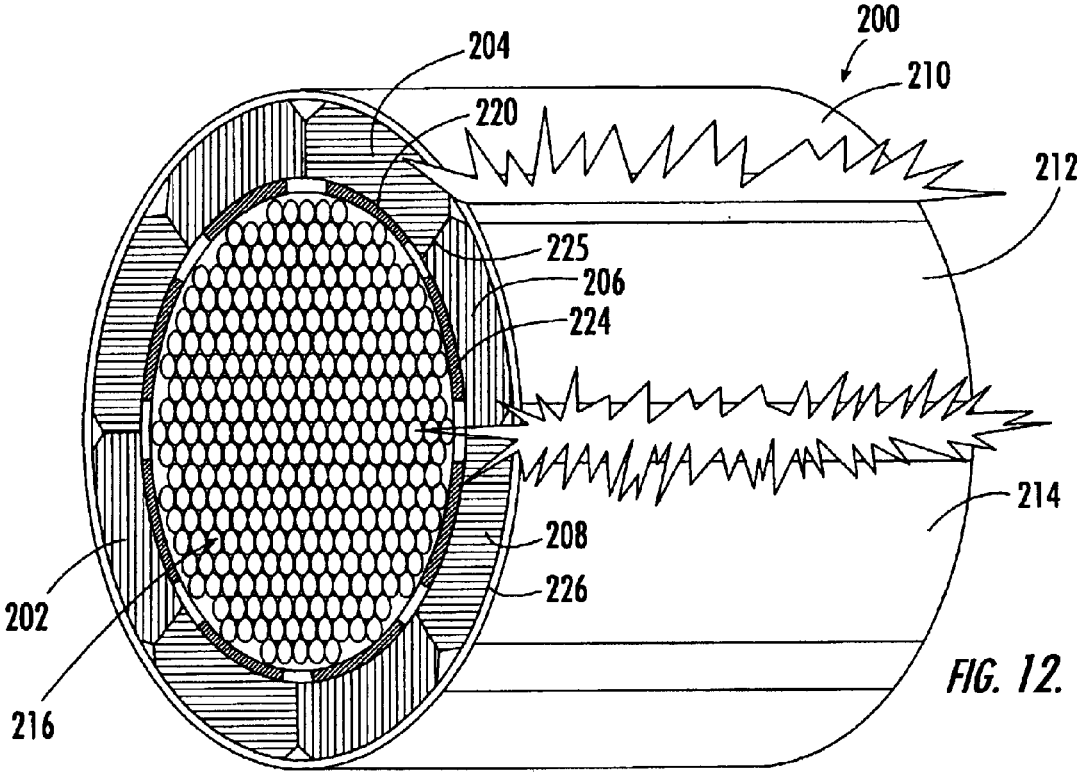
FIGS. 12–15 are schematic three-dimensional views showing how the projectiles of the kinetic energy rod warhead of the subject invention are aimed in a particular direction in accordance with the subject invention.
Figure 13:
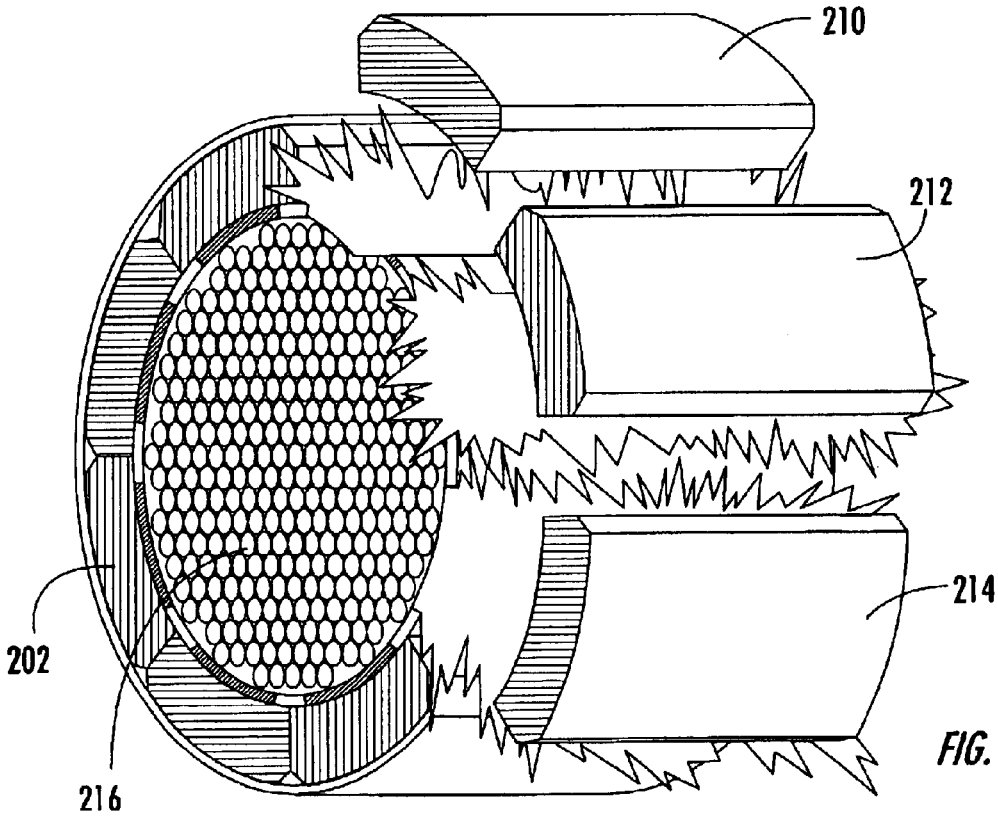
Figure 14:
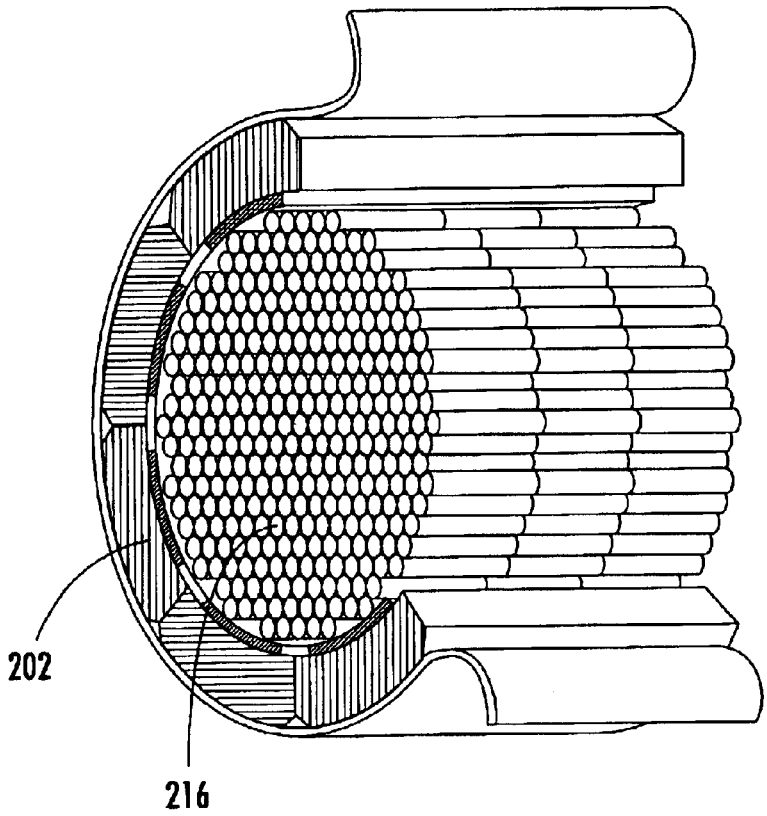
Figure 15:
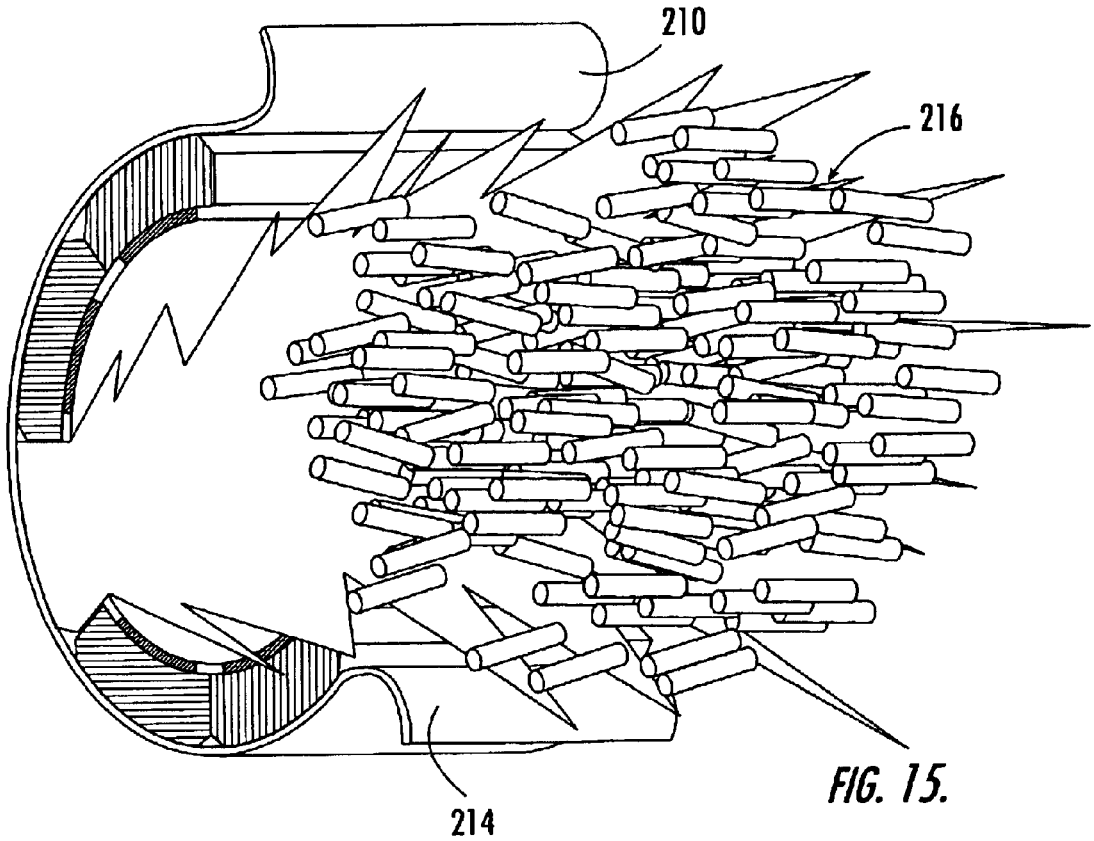

In FIG. 12, kinetic energy rod warhead 200 includes an explosive charge divided into a number of sections 202, 204, 206, and 208. Shields such as shield 225 separates explosive charge sections 204 and 206. Shield 225 maybe made of a composite material such as a steel core sandwiched between inner and outer lexan layers to prevent the detonation of one explosive charge section from detonating the other explosive charge sections. Detonation cord resides between hull sections 210, 212, and 214 each having a jettison explosive pack 220, 224, and 226. High density tungsten rods 216 reside in the core or bay of warhead 200 as shown. To aim all of the rods 216 in a specific direction and therefore avoid the situation shown at 78 in FIG. 5, the detonation cord on each side of hull sections 210, 212, and 214 is initiated as are jettison explosive packs 220, 222, and 224 as shown in FIGS. 13–14 to eject hull sections 210, 212, and 214 away from the intended travel direction of projectiles 216. Explosive charge section 202, FIG. 14 is then detonated as shown in FIG. 15 using a number of detonators as discussed with reference to FIGS. 6 and 8 to deploy projectiles 216 in the direction of the target as shown in FIG. 15. Thus, by selectively detonating one or more explosive charge sections, the projectiles are specifically aimed at the target in addition to being aligned using the aligning structures shown and discussed with reference to FIGS. 6 and 8 and/or FIG. 9 and/or FIG. 10.

In addition, the structure shown in FIGS. 12–15 assists in controlling the spread pattern of the projectiles. In one example, the kinetic energy rod warhead of this invention employs all of the alignment techniques shown in FIGS. 6 and 8–10 in addition to the aiming techniques shown in FIGS. 12–15.

Typically, the hull portion referred to in FIGS. 6–9 and 12–15 is either the skin of a missile (see FIG. 4) or a portion added to a "hit-to-kill" vehicle (see FIG. 3).

Figure 16:
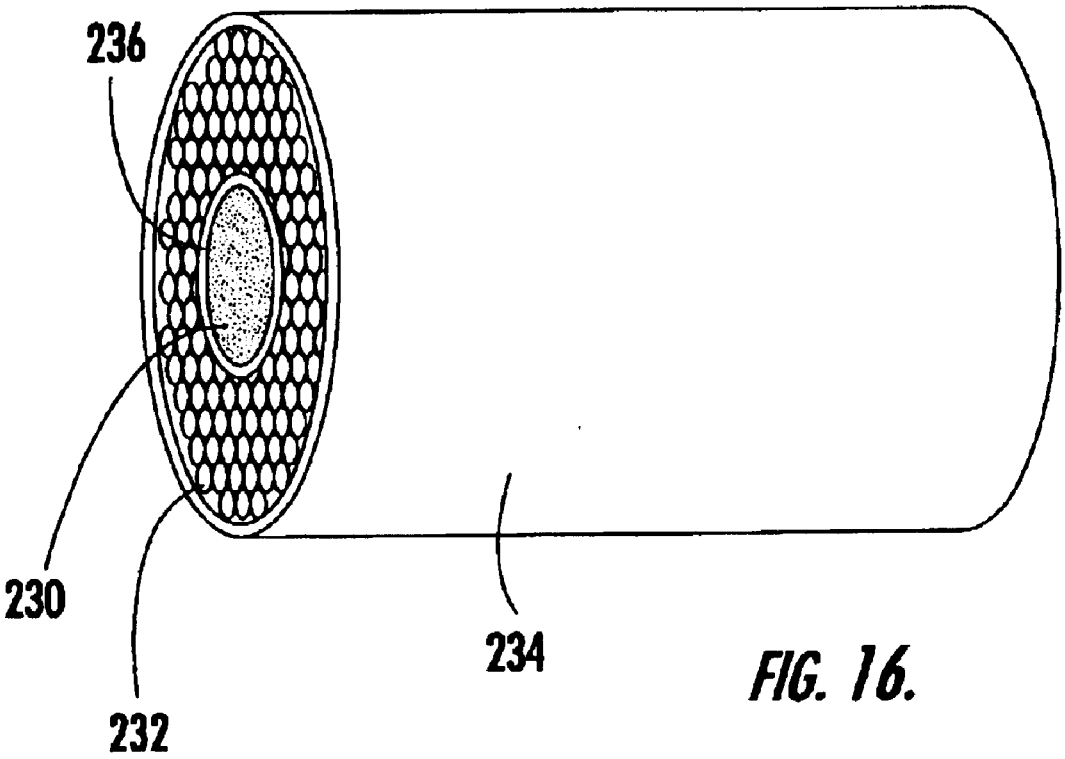
FIG. 16 is a three dimensional schematic view showing another embodiment of the kinetic energy rod warhead of the subject invention.
Figures 17, 18, 19, 20, 21, 22:
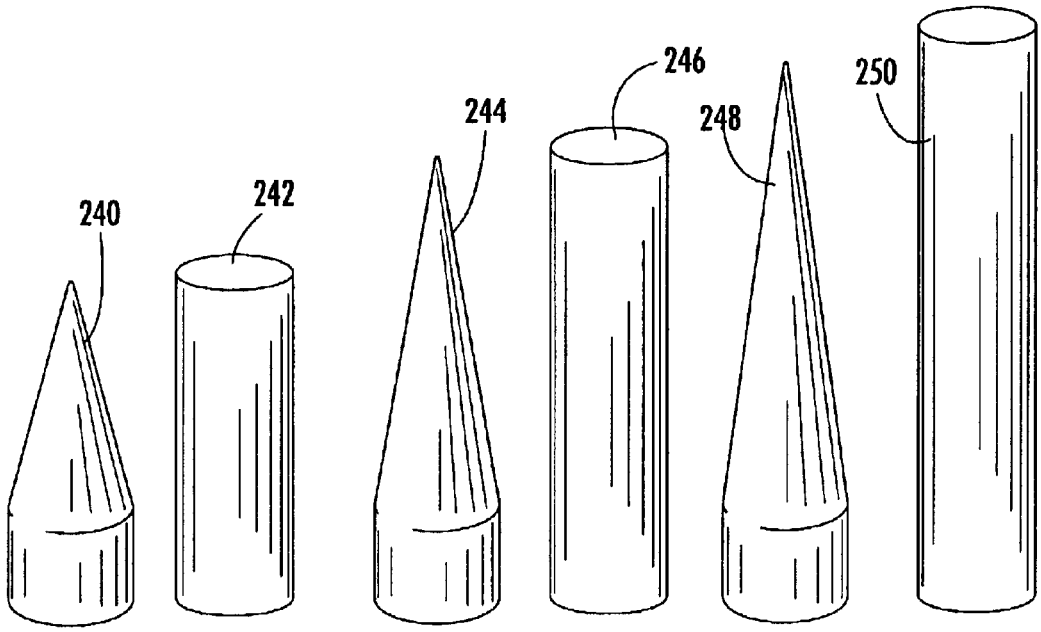
FIGS. 17–23 are three-dimensional views showing different projectile shapes useful in the kinetic energy rod warhead of the subject invention.

Thus far, the explosive charge is shown disposed about the outside of the projectile or rod core. In another example, however, explosive charge 230, FIG. 16 is disposed inside rod core 232 within hull 234. Further included may be low density material (e.g., foam) buffer material 236 between core 232 and explosive charge 230 to prevent breakage of the projectile rods when explosive charge 230 is detonated.

Thus far, the rods and projectiles disclosed herein have been shown as lengthy cylindrical members made of tungsten, for example, and having opposing flat ends. In another example, however, the rods have a non-cylindrical cross section and non-flat noses. As shown in FIGS. 17–24, these different rod shapes provide higher strength, less weight, and increased packaging efficiency. They also decrease the chance of a ricochet off a target to increase target penetration especially when used in conjunction with the alignment and aiming methods discussed above.

Figure 24:
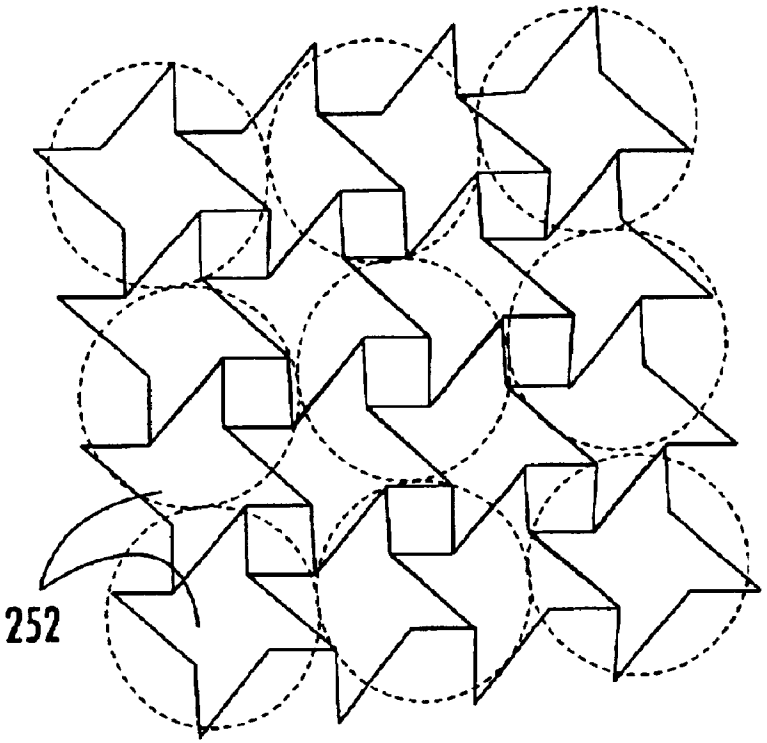
FIG. 24 is a end view showing a number of star-shaped projectiles in accordance with the subject invention and the higher packing density achieved by the use thereof.
Figure 23:
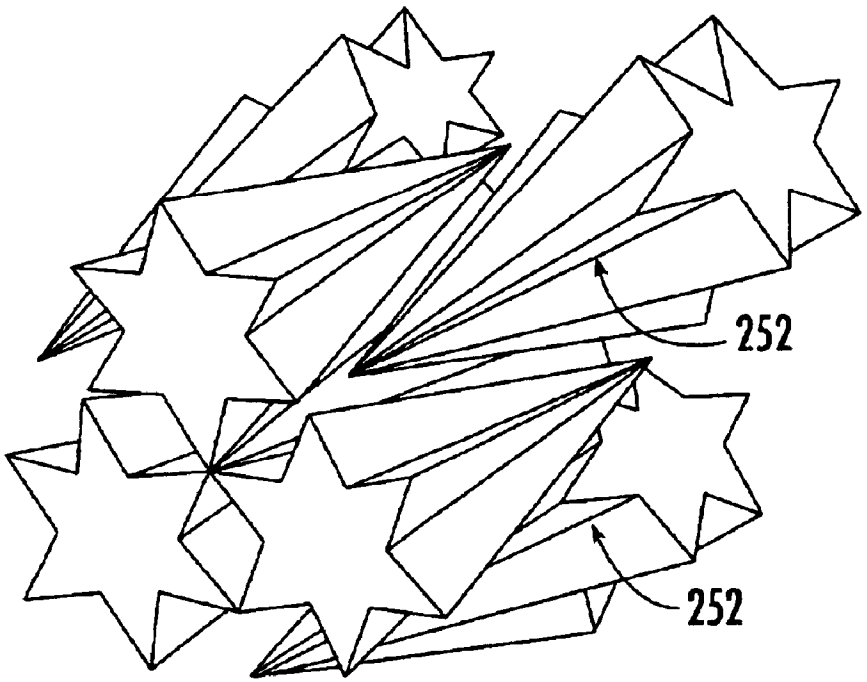

Typically, the preferred projectiles do not have a cylindrical cross section and instead may have a star-shaped cross section, a cruciform cross section, or the like. Also, the projectiles may have a pointed nose or at least a non-flat nose such as a wedge-shaped nose. Projectile 240, FIG. 17 has a pointed nose while projectile 242, FIG. 18 has a star-shaped nose. Other projectile shapes are shown at 244, FIG. 19 (a star-shaped pointed nose); projectile 246, FIG. 20; projectile 248, FIG. 21; and projectile 250, FIG. 22. Projectiles 252, FIG. 23 have a star-shaped cross section, pointed noses, and flat distal ends. The increased packaging efficiency of these specially shaped projectiles is shown in FIG. 24 where sixteen star-shaped projectiles can be packaged in the same space previously occupied by nine penetrators or projectiles with a cylindrical shape.

Figure 25:
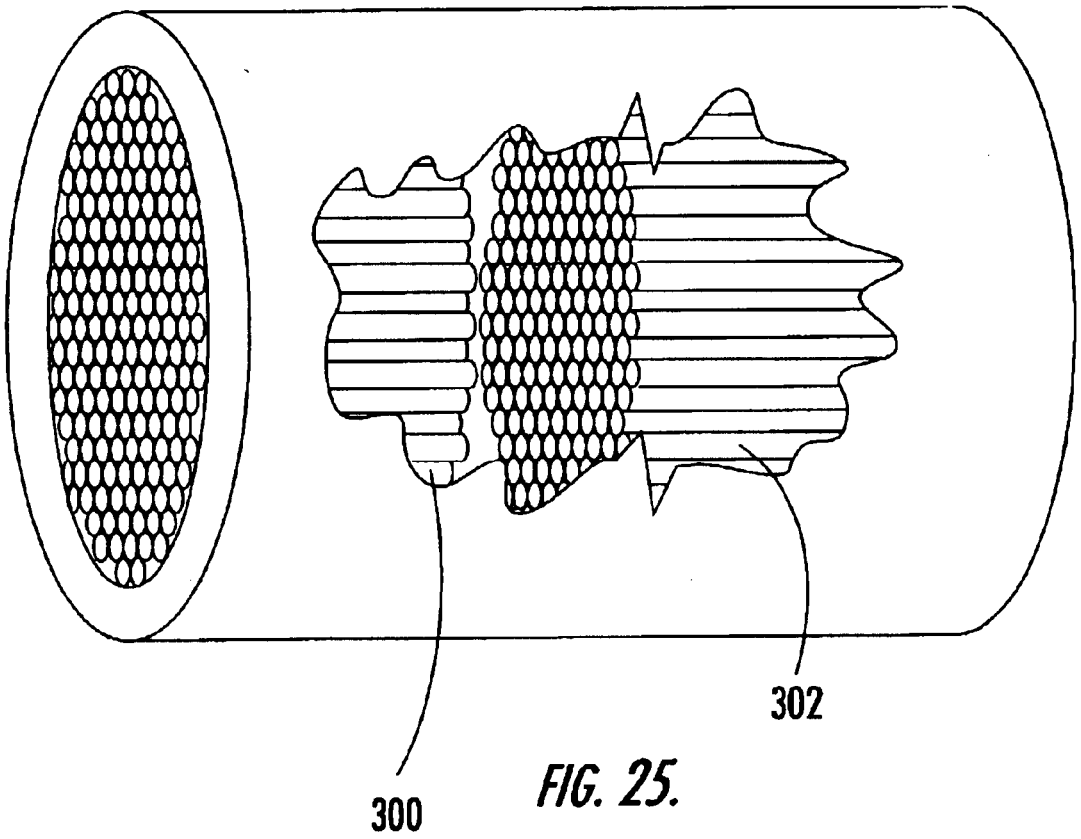
FIG. 25 is another schematic three-dimensional partially cut-away view of another embodiment of the kinetic energy rod warhead system of the subject invention wherein there are a number of projectile bays.
Figure 26:
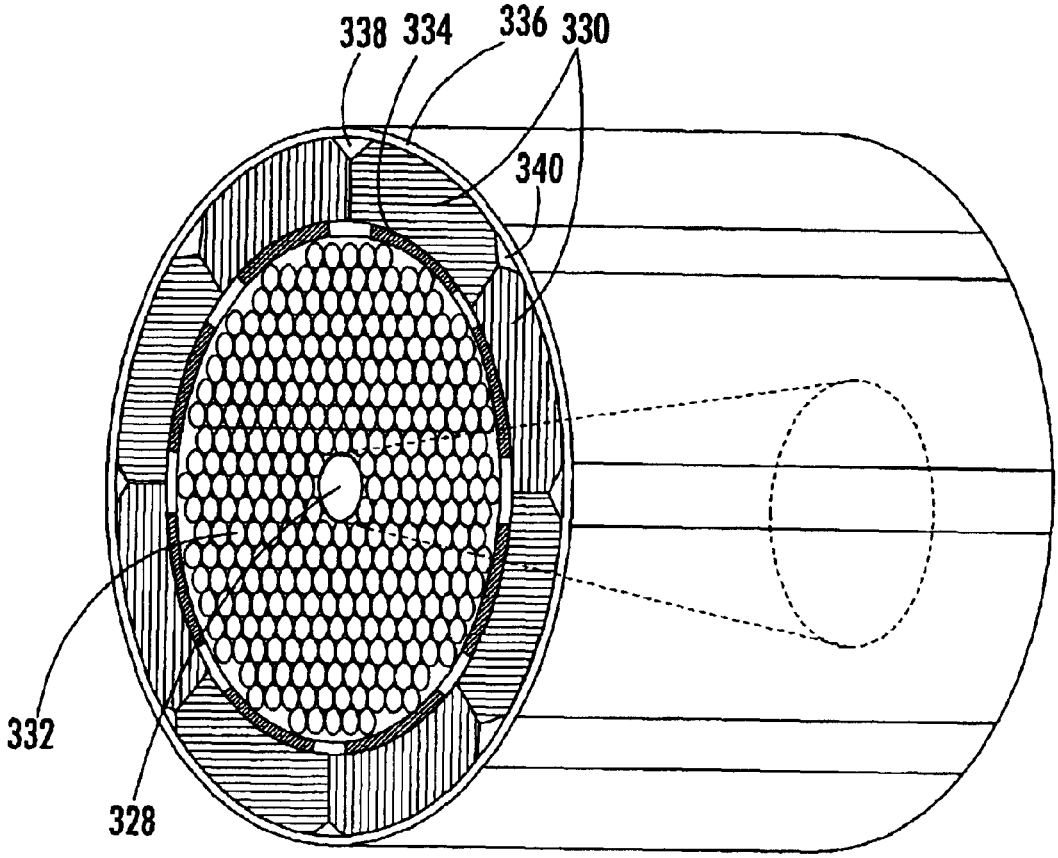
FIG. 26 is another three-dimensional schematic view showing an embodiment of the kinetic energy rod warhead system of this invention wherein the explosive core is wedge shaped to provide a uniform projectile spray pattern in accordance with the subject invention.
Figure 27:
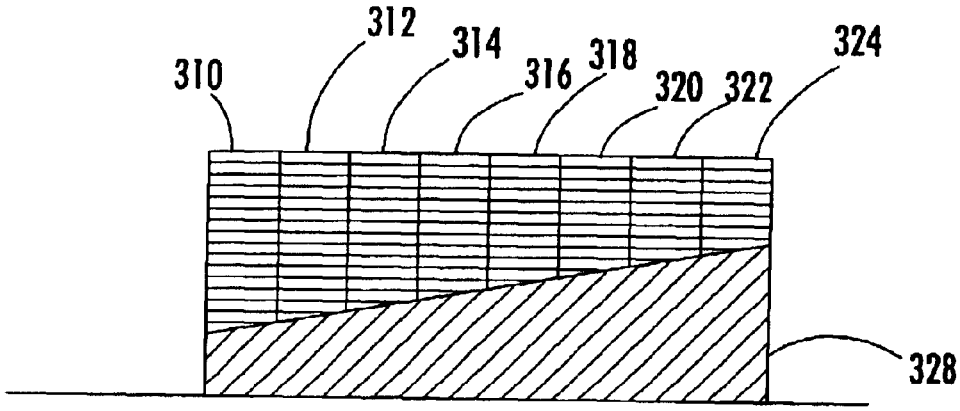
FIG. 27 is a cross sectional view showing the wedge shaped explosive core and the bays of projectiles adjacent it for the kinetic energy rod warhead system shown in FIG. 26.

Thus far, it is assumed there is only one set of projectiles. In another example, however, the projectile core is divided into a plurality of bays 300 and 302, FIG. 25. Again, this embodiment may be combined with the embodiments shown in FIGS. 6 and 8–24. In FIGS. 26 and 27, there are eight projectile bays 310–324 and cone shaped explosive core 328 which deploys the rods of all the bays at different velocities to provide a uniform spray pattern. Also shown in FIG. 26 is wedged shaped explosive charge sections 330 with narrower proximal surface 334 abutting projectile core 332 and broader distal surface 336 abutting the hull of the kinetic energy rod warhead. Distal surface 336 is tapered as shown at 338 and 340 to reduce the weight of the kinetic energy rod warhead.

In any embodiment, a higher lethality kinetic energy rod warhead is provided since structure included therein aligns the projectiles when they are deployed. In addition, the kinetic energy rod warhead of this invention is capable of selectively directing the projectiles at a target. The projectiles do not fracture, break or tumble when they are deployed. Also, the projectiles approach the target at a better penetration angle.

The kinetic energy rod warhead of this invention can be deployed as part of a missile or part of a kill vehicle. The projectile shapes disclosed herein have a better chance of penetrating a target and can be packed more densely. As such, the kinetic energy rod warhead of this invention has a better chance of destroying all of the bomblets and chemical submunition payloads of a target to thereby better prevent casualties.

A higher lethality kinetic energy rod warhead of this invention is effected by the inclusion of means for aligning the individual projectiles when they are deployed to prevent the projectiles from tumbling and to provide a better penetration angle, by selectively directing the projectiles at a target, and also by incorporating special shaped projectiles.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A kinetic energy rod warhead comprising:

a hull;

a projectile core in the hull including a plurality of individual projectiles;

an explosive charge in the hull about the core; and means for aligning the individual projectiles when the explosive charge deploys the projectiles.

2. The kinetic energy rod warhead of claim 1 in which the means for aligning includes a plurality of detonators spaced along the explosive charge, the detonators configured to prevent a sweeping shock wave, and configured to prevent tumbling of the projectiles upon detonation of the detonators.

3. The kinetic energy rod warhead of claim 1 in which the hull is an outer skin of a missile.

4. The kinetic energy rod warhead of claim 1 in which the explosive charge is outside the core.

5. The kinetic energy rod warhead of claim 1 further including a buffer material between the core and the explosive charge.

6. The kinetic energy rod warhead of claim 5 in which the buffer material is a low-density material.

7. The kinetic energy rod warhead of claim 1 in which the projectiles are lengthy metallic members.

8. The kinetic energy rod warhead of claim 7 in which the projectiles are made of tungsten.

9. The kinetic energy rod warhead of claim 1 in which the projectile core is divided into a plurality of bays.

10. The kinetic energy rod warhead of claim 1 in which the detonators are chip slappers.

11. A kinetic energy rod warhead comprising:

a hull;

a projectile core in the hull including a plurality of individual projectiles;

an explosive charge in the hull about the core; and a plurality of detonators spaced along the explosive charge, the detonators configured to prevent sweeping shock waves at the interface of the projectile core and the explosive charge to prevent tumbling of the projectiles.

12. A kinetic energy rod warhead comprising:

a hull;

a projectile core in the hull including a plurality of individual projectiles;

an explosive charge in the hull about the core;

means for aligning the individual projectiles when the explosive charge deploys the projectiles; and means for aiming the aligned projectiles in a specific direction.

13. The kinetic energy rod warhead of claim 12 in which the means for aligning includes a plurality of detonators spaced along the explosive charge, the detonators configured to prevent sweeping shock waves at the interface of the projectile core and the explosive charge to prevent tumbling of the projectiles.

14. The kinetic energy rod warhead of claim 12 in which the hull is an outer skin of a missile.

15. The kinetic energy rod warhead of claim 12 in which the explosive charge is outside the core.

16. The kinetic energy rod warhead of claim 12 in which the projectiles are lengthy metallic members.

17. The kinetic energy rod warhead of claim 16 in which the projectiles are made of tungsten.

18. The kinetic energy rod warhead of claim 12 in which the projectile core is divided into a plurality of bays.

19. The kinetic energy rod warhead of claim 13 in which the detonators are chip slappers.

* * * * *